United States Patent [19]

Hackett

[11] 4,273,340

[45] Jun. 16, 1981

[54] HORSESHOE STAKE SUPPORT APPARATUS

[76] Inventor: James L. Hackett, 522 N. Sierra Dr., Council Bluffs, Iowa 51501

[21] Appl. No.: 7,475

[22] Filed: Jan. 29, 1979

[51] Int. Cl.[3] ..... A63B 67/06

[52] U.S. Cl. ..... 273/336

[58] Field of Search ..... 273/100, 102.5, 104, 273/336-339, 371, 372, 346, 347, 377; 272/65, 101

[56] References Cited

U.S. PATENT DOCUMENTS

| | | | |
|---|---|---|---|
| 1,098,872 | 6/1914 | Akerberg | 273/100 |
| 1,513,968 | 11/1924 | Crandall | 273/100 |
| 2,230,294 | 2/1941 | Heggie | 273/104 |
| 2,722,420 | 11/1955 | Adamson | 273/102.5 |
| 2,917,311 | 12/1959 | Yurkut | 273/100 |
| 3,356,368 | 12/1967 | Dixon | 273/104 |
| 3,386,736 | 6/1968 | Fong | 273/338 |
| 3,844,560 | 10/1974 | Litsch | 273/104 |
| 4,174,107 | 11/1979 | Hickey | 273/58 C |

*Primary Examiner*—Richard C. Pinkham
*Assistant Examiner*—Scott L. Brown
*Attorney, Agent, or Firm*—Zarley, McKee, Thomte, Voorhees & Sease

[57] ABSTRACT

A portable horseshoe court includes a support frame, an elongated horseshoe stake, and a stake support block secured to the frame for supporting the stake in a generally upright position. The block has a hole through the top thereof which is adapted to axially receive the stake in press-fit relation therein. A plurality of flexible springs or the like are extended between and connected to opposite sides of the frame and a rubber pad, having a hole for the stake, rests on the frame and springs. The hole in the stake support block may be provided with an abutment member to fix the axial position of the stake therein. The frame may be a peripheral frame comprising oppositely disposed frame members having a pad support flange along the top side thereof. The top sides of the springs are arranged in the plane of the pad support flanges. An elongated chain connects a pair of courts to fix the regulation distance between them. Absent the rubber pad and flexible support springs, the support frame and stake support block combination may be buried in the ground or the like to securely anchor a horseshoe stake in upright relation in the ground.

14 Claims, 5 Drawing Figures

HORSESHOE STAKE SUPPORT APPARATUS

BACKGROUND OF THE INVENTION

The sport of horseshoes was originally played by pitching horseshoes onto stakes pounded into the ground a regulation distance apart. For more permanent courts, pairs of horseshoe pits were provided having clay surfaces and a stake generally centered in each pit. Finally, in recent years, some horseshoe courts have been constructed using a simulated clay surface of reclaimed rubber material supported on a box-like wood structure having an inflatable inner tube therein for additional support.

All of the known prior art apparatus for the sport of horseshoes have problems which limit their use. Stakes cannot be set up on a well groomed lawn without certain damage from the pitching of the shoes. Likewise, all outdoor horseshoe apparatus are at the mercy of the weather at all times and may be practically unusable in cold winter weather. Even the simulated courts having a rubber surface suffer the disadvantages that the protuding stake renders the apparatus bulky for storage and transport and the bottom wall of such apparatus adds undesirable weight. A further significant problem with the simulated courts is that of rigidly fixing the horseshoe stake without danger of breakage.

All of the above problems are believed to be solved by the portable horseshoe court of the present invention.

SUMMARY OF THE INVENTION

The portable horseshoe court of the present invention includes a peripheral frame having a stake support block detachably secured to a frame cross-member. An upright horseshoe stake is fixed in press-fit relation into a hole in the stake support block, thereby providing a nonwelded structure which assures against breakage. A plurality of elongated flexible members extend across the frame in spaced-apart relation to provide support for the resilient pad onto which the horseshoes are pitched. The pad has a hole for the stake to extend through but is otherwise free of fixed connections to the frame. The frame members are provided with a pad support flange along the upper edges thereof and the flexible members are arranged with a top side in the plane of the flange so as to eliminate any sharp edges which may damage the underside of the resilient pad.

Accordingly, it is a primary object of the invention to provide an improved portable horseshoe court.

A further object is to provide a portable horseshoe court with a nonwelded support means to prevent breakage of the stake.

A further object is to provide a portable horseshoe court having a resilient pad supported on a peripheral frame and by a plurality of flexible members for interior support of the pad.

A further object is to provide a portable horseshoe court which can be quickly and easily disassembled for compact storage and transport.

Finally, a further object is to provide a portable horseshoe court which is economical to manufacture, simple in construction and durable in use.

DESCRIPTION OF THE PREFERRED EMBODIMENT

Figure 1:
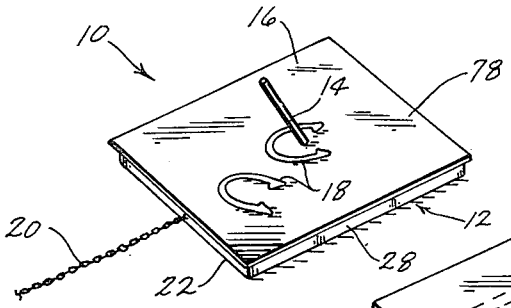
FIG. 1 is a perspective view of a portable horseshoe court of the invention.

The portable horseshoe court of the present invention, indicated generally at 10 in FIG. 1, includes a frame 12 which supports an upright stake 14 and a resilient pad 16 onto which horseshoes 18 are pitched. A chain 20 connects a pair of the portable courts for setting them the regulation distance apart.

Figure 2:
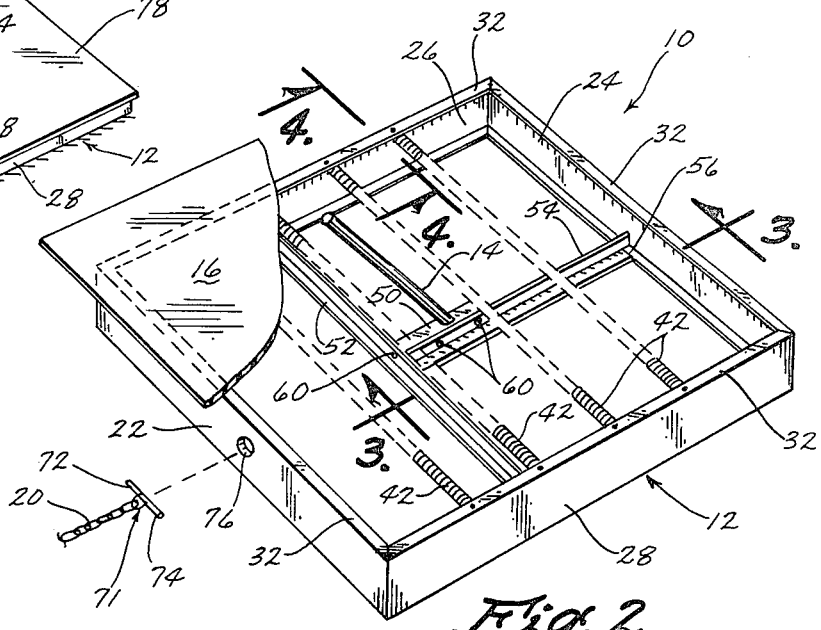
FIG. 2 is an enlarged perspective view of a portable horseshoe court with a portion of the pad cut away to show the underlying support structure.

Referring to FIG. 2, frame 12 is shown as a peripheral frame including opposite front and back frame members 22 and 24 and opposite side frame members 26 and 28 extended between and connected to the opposite ends of the front and back frame members. The frame members 22–28 are cut to length, notched and interlocked, at the ends and welded together to form a sturdy lightweight frame of solid welded construction. The frame members are preferably formed of channel material, as seen best in FIG. 4, wherein side frame member 26 is shown as including an upright base 30 having inwardly extended top and bottom flanges 32 and 34. The top flanges 32 present a flat pad supporting surface 36 arranged in a plane 38 parallel to the surface on which the court is supported. The top external edge of the channels is machined to a small radius, as indicated at 40, to protect the pad 16 from what otherwise would be a sharp edge.

Referring to FIG. 2, pad 16 is supported interiorly of the frame 12 by a plurality of elongated flexible members or springs 42 which are extended between and connected to the opposite side frame members 26 and 28. Although the flexible members 42 may be formed of various known types of natural and synthetic flexible materials, they are preferably provided as elongated helical tension springs as shown.

Figure 3:
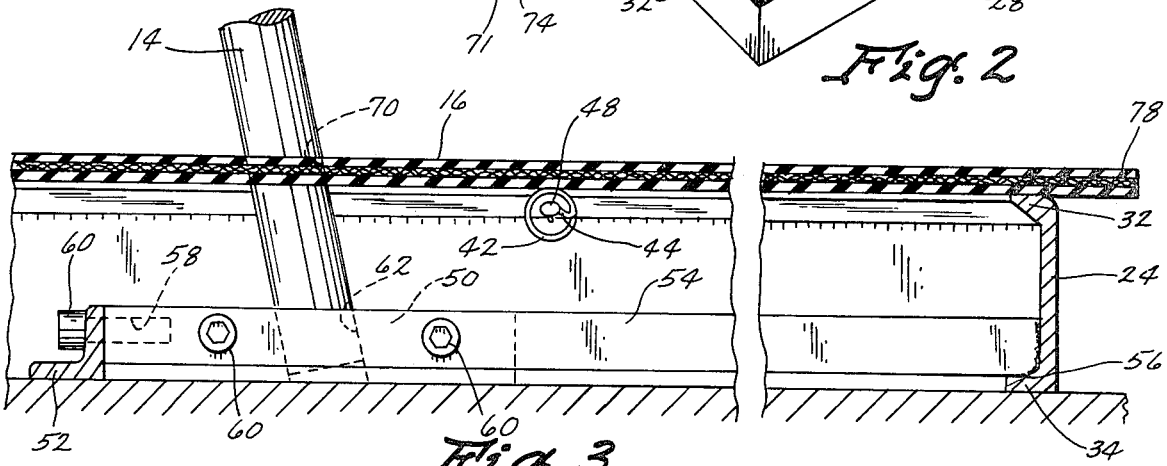
FIG. 3 is a further enlarged side sectional view taken along line 3—3 in FIG. 2.
Figure 4:
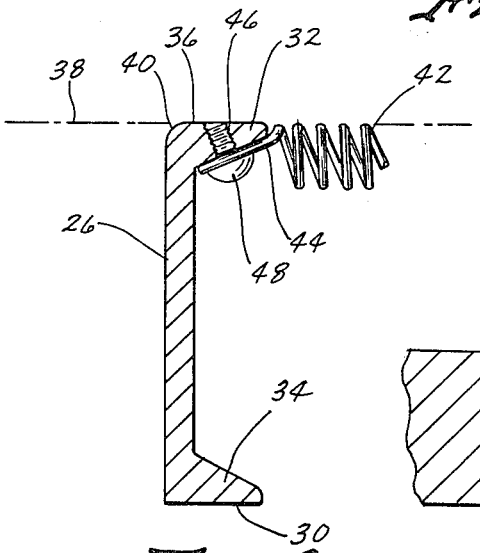
FIG. 4 is a still further enlarged front sectional detail view taken on line 4—4 in FIG. 2.

As shown in FIGS. 3 and 4, the end of each spring 42 is provided with an outwardly bent fastening loop 44 adapted for securement to the underside of the frame member flanges 32. For this purpose, tapped holes 46 are provided at spaced-apart positions along the underside of flange 32 for receiving screws 48 to fasten the springs 42 in place. Note that the springs 42 are so constructed relative to the frame members 26 and 28 that the top side of the springs 42 lie in the plane 38 of the frame members 22–28. Accordingly, the fastening screws and sharp ends of the springs are maintained away from the underside of the resilient pad to protect it and the springs 42 are disposed in engagement with the underside of the pad along their entire length.

Stake 14 is supported by a stake support block 50, as shown in FIGS. 2 and 3. Block 50 is preferably a solid steel block, substantially rectangular in cross section. To secure the block 50 relative to frame 12, a transverse frame cross member 52 is extended between and connected to side frame members 26 and 28 and a mounting bar 54 is secured at one end to the crossbar 52 and at the other end to the back frame member 24 to reinforce crossbar 52 and provide lateral support for the block 50. The crossbar 52 and mounting bar 54 are preferably formed of angle iron with the outer ends thereof notched as indicated at 56 in FIG. 3 for welding to the appropriate frame member along three surfaces as shown. The front end of mounting bar 54 presents a vertical face in abutment with crossbar 52 to which it is welded. The stake support block 50 has a tapped mounting hole 58 in the front end thereof and a pair of tapped mounting holes in one side for registration with respective mounting holes in the crossbar 52 and mounting bar 54 for receiving bolts 60 to rigidly fix the support block 50 in position at the intersection between the bars 52 and 54. The crossbar 52 and mounting bar 54 are perpendicular arranged so as to rigidly secure the stake support block 50 against both fore and aft and transverse movement.

To secure stake 14 to the block 50, a hole 62 opens through the top of the block 50 for axially receiving the stake 14 in press-fit relation therein. Accordingly, the stake 14 is rigidly secured relative to block 50 without danger of breakage due to welding. If welded to the top of block 50, stake 14 would be substantially weakened and likely to break under continued usage.

Figure 5:
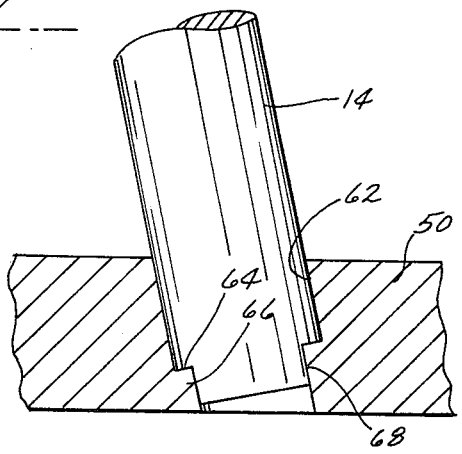
FIG. 5 is a partially sectional detail view of an alternate embodiment for the stake support block.

In an alternate embodiment shown in FIG. 5, stake support block 50 may be provided with a hole 62 including an abutment surface 64 in the form of an inwardly extended annular shoulder 66 for axially positioning the stake 14 in the hole. The lower end of stake 14 could likewise be stepped as indicated at 68 for insertion of the stepped end of the stake through annular shoulder 66.

The resilient pad 16 is preferably a relatively large flat piece of rubber material having a hole 70 for the stake to extend upwardly through. Other than the hole 70, it is preferred that the pad 16 is free of fixed connections to the frame 12. It has been found however, that the pad 16 remains in position simply by gravity and frictional contact with the frame and springs. Referring to FIG. 3, pad 16 is preferably provided as a cord woven rubber sided pad for additional strength.

Chain 20 interconnects a pair of courts 10 to secure them relative to one another and maintain them a regulation distance apart. Each end of chain 20 is provided with a coupling means or clip 71 having a pair of generally aligned legs 72 and 74 which are easily removably insertable into a hole 76 in the front frame member 22 when the legs are axially aligned with the hole. Once inserted, the legs 72 and 74 can be directed transversely to the hole 76 to catch the backside of front frame member 22 for attaching chain 20 to frame 12.

Although the invention is not limited to a structure of any particular dimensions, certain dimensions are preferred to meet the requirements for regulation play in organized tournaments and the like. For this purpose, the pad dimensions are considered as the court dimensions with a pad 34 inches long and 30 inches wide being preferred. The underlying frame 12 may be 30 inches long and 28 inches wide so that the pad is provided with an overhanging edge 78 as indicated in FIG. 3. The top surface of the pad should be no more than six inches from the ground or other supporting surface. Stake 14 may be constructed of one-inch diameter cold roll steel and extend 14 to 15 inches high at a forward inclination of 12° from the vertical.

In operation, it is only necessary to secure the stake support block 50 to the frame 12 by the three bolts 60 and to simply lay the pad 16 onto the frame 12 with stake 14 extending through the pad hole 70 to have one court ready for play. A second court can likewise be quickly assembled and the clips 70 which provide for rapid chain hookup enable both courts to be quickly and easily arranged at the regulation distance apart. The portable courts 10 can be used practically anywhere such as on a lawn, driveway, in parks, school playgrounds and indoors. With the present invention, one can provide horseshoe courts even without room for permanent courts and without damage to a lawn or any other surface. During play, the cords within the rubber pad 16 are designed to move independently, catching the impact of the horseshoes. The court design both provides impact resistance and prevents the rubber from ripping. The specially designed playing surface of pad 16 and the all metal construction frame 12 assure a long useful life for the portable horseshoe court. When not in use, the stake support block 50 may be easily disassembled from the frame 12 with access provided from either side of the frame and the frames and pads may be arranged in stacked relation with the stakes, shoes and chain positioned between them, if desired, so as to provide a compact package for storage or transport.

Absent the rubber pad 16 and flexible support springs 42, it will be appreciated that the support frame 12 of the present invention provides an ideal structure for anchoring a horseshoe stake in the ground or the like for permanent court installations. Presently, it is the common practice to secure one end of a horseshoe stake in a cut length of railroad tie and to bury the railroad tie several inches below ground surface to anchor the horseshoe stake in the ground. However, the blocks tend to become loosened after continuous use and in any event, require periodic replacement due to rotting of the wood. Replacement requires the entire tie to be removed from the ground and replaced.

The support frame 12 of the present invention provides a longer and substantially wider anchor for a horseshoe stake which therefore results in greater stability and less frequent replacement. When replacement is necessary due to damage or bending of the stake, the entire frame need not be removed from the ground. Rather, only the earth surrounding the stake need be removed to provide access to the bolts 60 which secure the stake support block 50 to the frame. Thus, replacement of the stake may be accomplished without disturbing the well packed earth above the frame members 22–28.

Accordingly, there has been shown and described a horseshoe stake support apparatus which accomplishes at least all of the stated objects.

I claim:

1. A portable horseshoe court comprising, a generally peripheral support frame, an elongated horseshoe stake, a horseshoe stake support block, said block having a hole which opens through the top thereof for receiving said horseshoe stake, said stake being received in press-fit relation in said hole whereby said stake is rigidly secured relative to said block, means for operatively securing said stake support block to said frame, a plurality of elongated flexible support means extended across said peripheral frame and connected at opposite ends thereof to said peripheral frame, a pad adapted to be supported on said frame and flexible support means, said pad having a hole for said stake to extend upwardly therethrough, and said flexible support means being the only vertical support for said pad interiorly of said pheripheral frame whereby resilient stretching movement of said flexible support means in response to a horseshoe being pitched onto said pad permits said pad to resiliently yield in a vertical direction, thereby to at least partially absorb the impact of said horseshoe.

2. The portable horseshoe court of claim 1 further comprising abutment means secured relative to the stake receiving hole in said block, said stake being adapted for abutment against said abutment means to axially position said stake in the hole.

3. The portable horseshoe court of claim 2 wherein said abutment means comprises an inwardly extended annular shoulder on the sidewall of said hole.

4. A portable horsehoe court comprising, a support frame including spaced-apart opposite frame portions, an elongated stake, means for rigidly supporting said stake on said frame so as to extend upwardly therefrom, a plurality of elongated flexible support means extended between and connected to the opposite frame portions, and a resilient pad adapted to overlie said frame so as to be supported on said frame and flexible support means, said flexible support means being the only vertical support for said pad interiorly of said support frame whereby resilient stretching movement of said flexible support means in response to a horseshoe being pitched onto said pad permits said pad to resiliently yield in a vertical direction, thereby to at least partially absorb the impact of said horseshoe.

5. The portable horseshoe court of claim 4 wherein said flexible support means comprises a spring.

6. The portable horseshoe court of claim 5 wherein said spring comprises an elongated helical tension spring.

7. The portable horseshoe court of claim 5 wherein said opposite frame portions have upper edges arranged in a plane and said spring is so connected to the opposite frame portions that the top side of said spring is generally disposed in said plane.

8. The portable horseshoe court of claim 7 wherein said frame comprises a peripheral frame including opposite front and back frame members and opposite side frame members extended between and connected to said front and back frame members, said flexible support means being extended between and connected to opposite frame members.

9. The portable horseshoe court of claim 8 wherein said flexible support means are extended between and connected to said opposite side frame members.

10. The portable horseshoe court of claim 4 wherein said pad rests on the frame, said pad and frame being free of fixed connections therebetween.

11. The portable horseshoe court of claim 4 further comprising an elongated court spacing member having coupling means at each end thereof for connection to a pair of courts to fix the distance therebetween.

12. The portable horseshoe court of claim 4 wherein said pad is larger than said frame so as to include an overhanging edge portion.

13. A portable horseshoe court comprising, a support frame including spaced-apart opposite frame portions, an elongated stake, means for rigidly supporting said stake on said frame so as to extend upwardly therefrom, a plurality of elongated flexible support means extneded between and connected to the opposite frame portions, and a resilient pad adapted to overlie said frame so as to be supported on said frame and flexible support means, said flexible support means comprising a spring, said opposite frame portions having upper edges arranged in a plane and said spring being so connected to the opposite frame portions that the top side of said spring is generally disposed in said plane, said frame comprising a peripheral frame including opposite, front and back frame members and opposite side frame members extended between and connected to said front and back frame members, said flexible support means being extended between and connected to opposite frame members, said frame members including a pad support flange along the upper edges thereof.

14. The portable horseshoe court of claim 13 wherein each end of said elongated flexible support means is connected to the underside of said flange.

* * * * *